US009567815B2

(12) United States Patent
Latiolais, Jr. et al.

(10) Patent No.: US 9,567,815 B2
(45) Date of Patent: Feb. 14, 2017

(54) LOAD RING FOR LIFTING BY ELEVATOR, OF CASING HAVING AN UPSET

(71) Applicant: Frank's International, LLC, Houston, TX (US)

(72) Inventors: Burney J. Latiolais, Jr., Lafayette, LA (US); Keith T. Lutgring, Lafayette, LA (US); Braxton I. Moody, V, Tomball, TX (US); John K. M. Saichuk, Lafayette, LA (US); Samuel P. Hawkins, III, Scott, LA (US)

(73) Assignee: Frank's International, LLC, Houston, TX (US)

( * ) Notice: Subject to any disclaimer, the term of this patent is extended or adjusted under 35 U.S.C. 154(b) by 0 days.

(21) Appl. No.: 14/600,249

(22) Filed: Jan. 20, 2015

(65) Prior Publication Data

US 2015/0197996 A1 Jul. 16, 2015

Related U.S. Application Data

(63) Continuation of application No. 13/694,404, filed on Nov. 29, 2012, now Pat. No. 8,936,292, which is a continuation of application No. 12/082,736, filed on Apr. 14, 2008, now Pat. No. 8,348,320, which is a continuation of application No. 10/690,445, filed on Oct. 21, 2003, now Pat. No. 7,357,434, and a continuation of application No. 10/689,913, filed on Oct. 21, 2003, now Pat. No. 7,159,619.

(51) Int. Cl.

| | |
|---|---|
| ***B66C 1/10*** | (2006.01) |
| ***B65D 59/06*** | (2006.01) |
| ***E21B 19/12*** | (2006.01) |
| ***E21B 19/10*** | (2006.01) |
| ***E21B 19/02*** | (2006.01) |
| ***E21B 19/06*** | (2006.01) |

(52) U.S. Cl.

CPC ..... *E21B 19/12* (2013.01); *E21B 19/02* (2013.01); *E21B 19/06* (2013.01); *E21B 19/10* (2013.01)

(58) Field of Classification Search

CPC ..... E21B 19/12; E21B 19/10

USPC ..... 294/119.2, 90, 92, 16, 31.2, 86.4, 113; 138/96 T, 96 R, 98 T; 248/141; 414/621

See application file for complete search history.

(56) References Cited

U.S. PATENT DOCUMENTS

| | | | | |
|---|---|---|---|---|
| 625,573 A | | 5/1899 | Leavit | |
| 1,600,860 A | | 9/1926 | Young | |
| 2,073,389 A | | 3/1937 | Engstrom | |
| 2,175,414 A | | 10/1939 | Stevenson | |
| 2,196,454 A | * | 4/1940 | Kahn | B65D 59/00 138/96 T |
| 2,292,310 A | | 8/1942 | Wilkins | |
| 2,628,134 A | | 2/1953 | Williams et al. | |
| 2,880,761 A | | 4/1959 | Peter | |

(Continued)

*Primary Examiner* — Paul T Chin

(57) ABSTRACT

A load lifting apparatus comprises a first housing, a second housing and a mechanical obstruction structure(s). The first housing is sized to slide over an upset tubular having a given diameter, wherein the first housing comprises the mechanical obstruction structure(s) that is designed to move radially inward when engaged with the second housing. The compressed internal diameter of the mechanical obstruction structure(s) can contact the upset tubular, wherein the upset tubular can then be supported by the mechanical obstruction structure(s) and the second housing, for safely lifting the upset tubular.

20 Claims, 15 Drawing Sheets

(56) References Cited

U.S. PATENT DOCUMENTS

| | | | | | |
|---|---|---|---|---|---|
| 2,952,482 | A | * | 9/1960 | Torres | F16L 37/121 285/1 |
| 3,038,502 | A | | 6/1962 | Hauk et al. | |
| 3,240,232 | A | | 3/1966 | Matherne | |
| D205,677 | S | | 9/1966 | Hartshorn | |
| 3,485,271 | A | | 12/1969 | Halsey | |
| 3,675,278 | A | * | 7/1972 | Powell | E21B 19/07 188/67 |
| 3,858,613 | A | | 1/1975 | Musslewhite | |
| 4,009,898 | A | | 3/1977 | Hampton | |
| 4,018,468 | A | | 4/1977 | Lundquist | |
| 4,349,048 | A | | 9/1982 | Clark | |
| 4,354,529 | A | | 10/1982 | Soutsos et al. | |
| 4,601,334 | A | * | 7/1986 | Lovegrove | E21B 17/1035 138/110 |
| 4,730,853 | A | * | 3/1988 | Gjessing | F16L 1/26 138/89 |
| 4,817,992 | A | * | 4/1989 | Yip | E21B 33/038 285/18 |
| 4,893,861 | A | * | 1/1990 | Stoltzman | B65D 25/22 220/649 |
| 5,148,835 | A | | 9/1992 | Clark | |
| 5,368,074 | A | | 11/1994 | Hall | |
| 5,524,672 | A | | 6/1996 | Mosing et al. | |
| 5,706,894 | A | | 1/1998 | Hawkins, III | |
| 5,819,805 | A | | 10/1998 | Mosing et al. | |
| 6,416,096 | B1 | | 7/2002 | Stefanik et al. | |
| 7,159,619 | B2 | | 1/2007 | Latiolais et al. | |
| 7,357,434 | B2 | | 4/2008 | Latiolais et al. | |
| 2005/0006147 | A1 | * | 1/2005 | Ayling | E21B 19/10 175/57 |
| 2005/0082857 | A1 | | 4/2005 | Latiolais et al. | |
| 2012/0061528 | A1 | | 3/2012 | Roth et al. | |

* cited by examiner

LOAD RING FOR LIFTING BY ELEVATOR, OF CASING HAVING AN UPSET

CROSS REFERENCE TO RELATED APPLICATIONS

This application is a continuation-in-part application that claims priority to the U.S. patent application having the Ser. No. 13/694,404, filed Nov. 29, 2012, which will issue as U.S. Pat. No. 8,936,292 on Jan. 20, 2014 and which claims priority to the U.S. patent application having the Ser. No. 12/082,736, filed Apr. 14, 2008, which in turn claims priority to the U.S. patent application having the Ser. No. 10/690,445, filed Oct. 21, 2003 and is related to the U.S. patent application having the Ser. No. 10/689,913, filed Oct. 21, 2003. All of the above-referenced patents and applications are incorporated by reference herein in their entireties.

TECHNICAL FIELD

This invention relates, generally, to apparatus which are useful for safely transporting oilfield tubulars, and specifically, to raising and/or lowering a length of oilfield tubulars, and/or for otherwise safely moving a length of oilfield tubulars.

BACKGROUND OF THE INVENTION

Tubular goods, whose use includes, but is not limited to, use in drilling for, and production of oil and gas, experience a considerable amount of handling and a certain degree of mishandling and abuse on their journey from the steel mill to the final well destination. As a result, screw on cylindrical thread protectors, with a full compliment of threads, are placed on such tubular goods to protect the threads from any harm prior to installation. However, because the removal of such protectors often requires an expenditure of time that cannot be tolerated during the installation of tubular strings in wells, the original protector is often removed at the well site and is replaced with a different protector with quick release and installation capabilities. The tubular good subsequently rides from rack to rig with the new thread protector, which is eventually removed when the joint is to be threadedly attached to the downwardly continuing string. During the interval that the protector is on the threads, a last bore drift test is usually done, and it is desirable that the protector does not interfere with the drift passage. Once the string is pulled out of the hole, the quick install capabilities of such a thread protector ensure protection for the threads on tubular goods whose threads have not been damaged in the drilling activity.

A considerable amount of development work has been done in efforts to improve the bands and related tensioning gear to keep the casing protectors from being knocked off the threads during the rack to well trip.

The body of protectors in rig site use are currently made of elastomer, sometimes polyurethane, but may sometimes be made of other material, such as black rubber. The elastomer is formulated and cured to serve the skid and bash protection function and does not always favor thread gripping. In order for the elastomer to adequately grip the threads on the tubular goods to be protected, a sufficient amount of hoop force must be applied, which is often accomplished through the tensioning of bands around the elastomer. However, such securing bands are designed to be tensioned by hand and consequently, seldom have enough energy to drive the elastomer into the thread grooves sufficiently to prevent the occasional slipping of the protector.

Furthermore, the thread protectors on the rig site are currently designed so that the elastomer is pulled apart to accommodate the threads to be protected and subsequently tightened around such threads when the protector is in place. The net effect of repetitive pulling apart is that the elastomer would eventually deform due to the repetitive yielding, causing the elastomer to lose its memory characteristics.

There have been many attempts in this art to provide improved protectors for male threads on the pin end of oilfield tubulars. U.S. Pat. No. 5,524,672 to Mosing, et al, and U.S. Pat. No. 5,819,805 to Mosing, et al, each having been assigned to Frank's Casing Crew and Rental Tools, Inc., are two such prior art patents. The prior art has typically used components which are in intimate contact with the male threads, and while they oftentimes have been used with a great deal of success, these components have sometimes failed to protect the threads when the tubular is dropped or banged against hard surfaces, such as rig floors of ramps and truck bodies. This is especially true when such prior art protectors are used with two-step threaded oilfield tubulars having premium threads.

U.S. Pat. No. 5,706,894 to Samuel P. Hawkins, assigned to Frank's International, Inc., the assignee of this present invention, shows a device for suspending various downhole tools below the device, for repair and maintenance purposes. Moreover, there have been many attempts to provide lifting surface on the exterior of smooth surfaced oilfield tubulars to which elevators can be attached to either raise, lower, or otherwise move said oilfield tubulars.

U.S. Patent Application No. 2012/0061528 discloses a gripping device for engaging a tubular with a collet structure to receive a tubular. The collet has a plurality of elongated blades, with each blade having a gripping structure at the unsupported end. Because the device requires a gripping surface to establish resistance, the device will not work with tubulars (e.g., casing) that has a tapered or swaged connection or tubulars (e.g., casing) that has an integral box end. Such upset tubulars or casing therefore comprise varying diameters, which are not controlled generally by the American Petroleum Institutes' specifications; and as such, it is difficult to design and engineer a gripping device(s) and/or a gripping surface(s) that can handle one or more of the varying upsets of the tubulars. In addition, sufficient frictional forces are required in order to enable a gripping surface to work; however, if the frictional forces are too high (e.g., intense), then the intense frictional force can cause damage to the tubulars. Accordingly, there is a need for a load ring lifting device that can be suitable for casing or upset tubulars, which have a tapered or swaged end or connection, and/or include an integral box end. In addition, there is a need for a load ring lifting device that does not require the use of intense frictional forces for forming a gripping surface. The embodiments of this invention satisfy these needs.

The objects, features and advantages of this invention will be apparent to those skilled in this art from a consideration of this specification, including the attached claims, the included Abstract, and the appended drawings.

DETAILED DESCRIPTION OF THE DRAWINGS

The present invention generally relates to an apparatus for lifting upset oilfield tubulars, including casing. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. The disclosure and description herein is illustrative and explanatory of one or more embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose one or more embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "open", "closed", "first", "second", "inside", "outside", "interior", "exterior", "inward," "outward" and so forth are made only with respect to explanation in conjunction with the drawings, and that components may be oriented differently, for instance, during insertion or lifting upset oilfield tubulars. Because many varying and different embodiments may be made within the scope of the concept(s) herein taught, and because many modifications may be made in the embodiments described herein, it is to be understood that the details herein are to be interpreted as illustrative and non-limiting.

Figure 1:
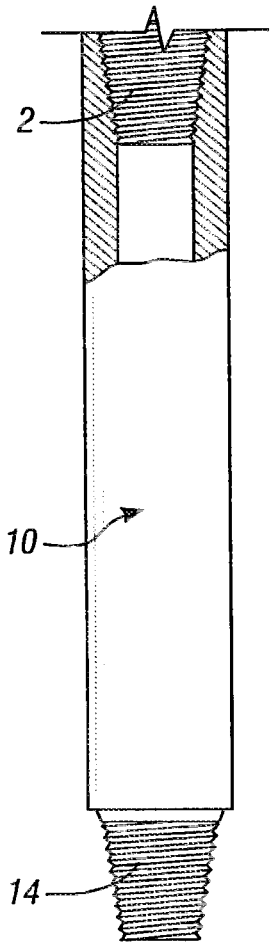
FIG. 1 (PRIOR ART)
FIG. 1 is an elevated view, partly in cross section, in an oilfield tubular, which is well-known in this art.

Referring now to the drawings in more detail, FIG. 1 is a conventional joint of oilfield tubular 10, for example, a joint of steel casing, which is well known in this art, which can typically be cemented into a drilled earth borehole, as is well known in the art. Such joints typically have a box end 2, having internal threads, and a pin end 14 having external threads. The box end 2 and the pin end 14 are commonly referred to as the female end and the male ends, respectively. As will be discussed hereinafter, the use of thread protectors in this art is usually concerned with protecting the threads of the pin end 14, because of the threads being exposed to the possibility of being dropped and banged around.

Figure 2:
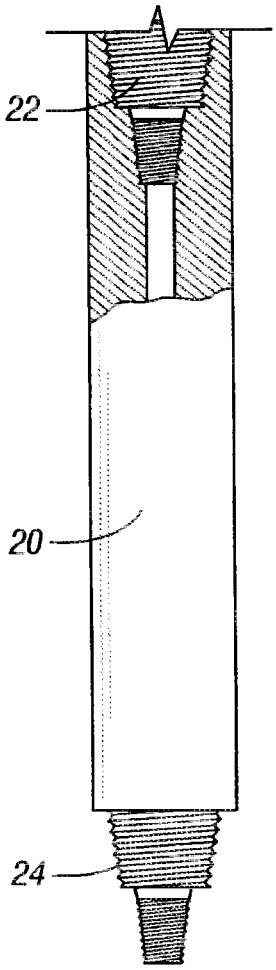
FIG. 2 (PRIOR ART)
FIG. 2 is an elevated view, partly in cross section, of another oilfield tubular known in the prior art having premium, multi-step threads on its pin end.

FIG. 2 is a conventional joint 20 of oilfield tubular, also known in this art, for example, a joint of steel casing having a box end 22 and a pin end 24. The box end 22 and the pin end 24 involve two-step premium threads, well-known in this art, and which have proved to be troublesome for which to provide thread protection, for example for the pin end 24.

Figure 3:
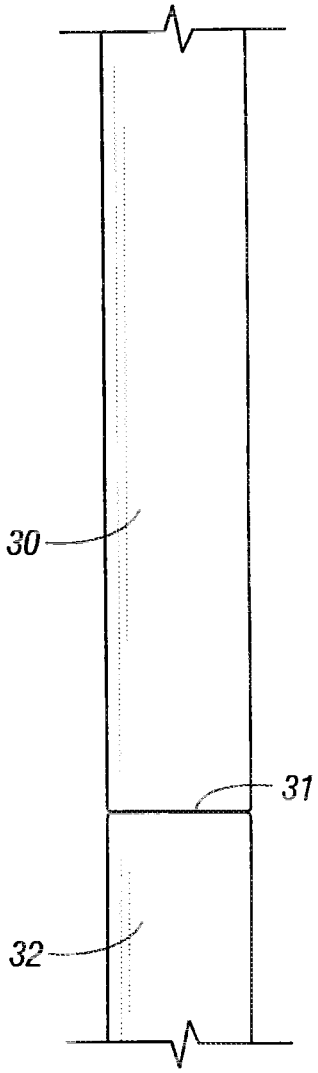
FIG. 3 (PRIOR ART)
FIG. 3 is an elevated, schematic view of a pair of oilfield tubulars threaded together to create a smooth connection, also known in the prior art.

FIG. 3 illustrates a pair of oilfield tubulars 30 and 32, for example, steel casing. The tubular 30 and the tubular 32 may, for example, each be duplicates of tubular 10 shown in FIG. 1 or duplicates of tubular 20 shown in FIG. 2. When threaded together as illustrated in FIG. 3, this is known as a "flush" connection, for example, at the connection line 31.

Figure 4:
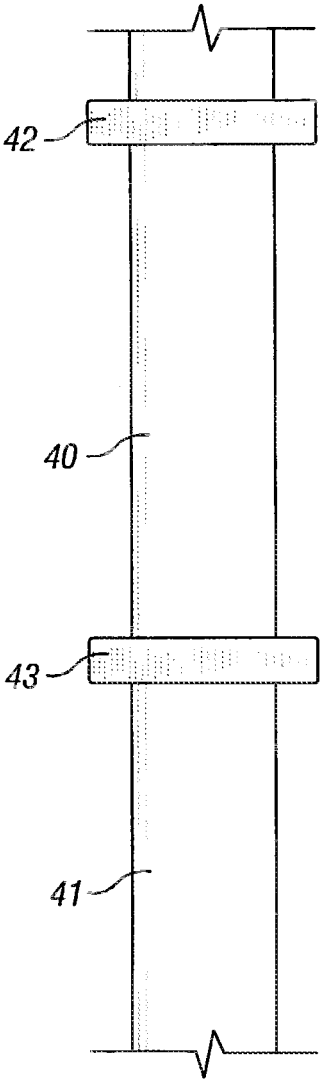
FIG. 4 (PRIOR ART)
FIG. 4 is an elevated view of a pair of oilfield tubulars threaded together, and having a plurality of built-in collars which act as an upset, well-known in the prior art, to which an elevator can be attached for lifting or raising or otherwise moving each of the tubulars, as is well-known in the art when such collars are present.

In FIG. 4 of the drawings, there is illustrated the prior art assembly having a first oilfield tubular 40 threaded into a second oilfield tubular 41, each of which may be, for example, joints of steel casing. The casing joints 40 and 41 have a collar 42 and a collar 43, respectively, which can be used in conjunction with an elevator (not illustrated), which facilitates the raising or lowering of the tubular joints 40 and 41 into or out of an earth borehole. Collars 42 and 43 also facilitate the lifting of the casing string having the joints 40 and 41 into or out of the pipe racks used in conjunction with the running in or running out of the tubular string.

Figure 5:
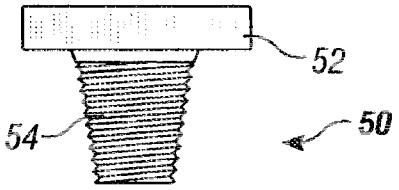
FIG. 5 (PRIOR ART)
FIG. 5 illustrates a prior art device known as a nubbin which can be threaded into a box end of an oilfield tubular to provide a shoulder to which an elevator can be attached for moving an oilfield tubular up or down or otherwise moving such oilfield tubulars.

FIG. 5 shows a prior art nubbin 50 having a collar 52 and a threaded portion 54, having male threads, which can be threaded into, for example, the box end 2 of the tubular joint 10 illustrated in FIG. 1.

When the nubbin 50 (shown in FIG. 5) is being used with the joint 10, illustrated in FIG. 1, after the nubbin is threaded into the tubular joint 10, an elevator can be attached to the collar 52 to raise or lower the tubular joint 10, when the casing string is being made up or disassembled. In effect, the use of the nubbin 50 in the prior art enables the simulation of the use of collar joints illustrated in FIG. 4, all as is known in the prior art. It should be appreciated that while the nubbin 50 works sufficiently well to enable the joint of casing to be raised or lowered by an elevator, use of the nubbin 50 can be quite burdensome if used with very large joints of steel casing. For example, the nubbin 50 weighs approximately 150 pounds and when sized to use with 18 inch steel casing, requires, sometimes, three men to hold the nubbin 50 over their heads, and to thread the nubbin 50 into the box end of the casing joint to be manipulated. This sometimes can take undue amounts of time, for example, fifteen or twenty minutes, to thread the nubbin 50 into the large diameter casing joint and, then, to be removed as soon as the casing joint is threaded into the joint of casing immediately below it in the casing string. This burdensome, time consuming use of the nubbin is well-known in this art.

Figure 6:
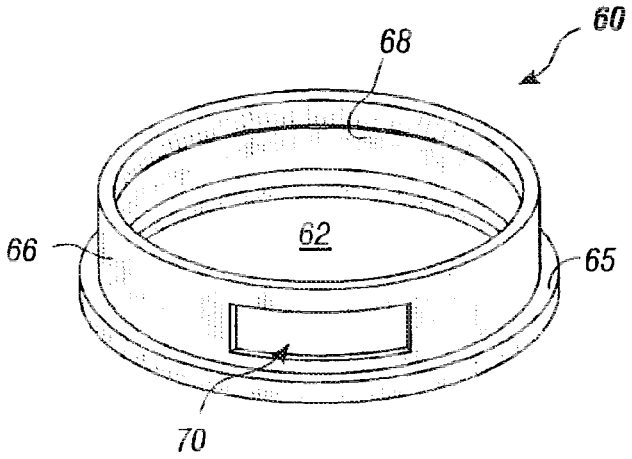
FIG. 6 is an isometric, pictorial view of an apparatus according to the present invention which together with the band illustrated in FIGS. 7 and 8 can be used to attach to the external surface of an oilfield tubular and to which an elevator may be attached.

Referring now to FIG. 6, there is illustrated an isometric, pictorial view of a steel or other metallic ring member 60 having a central flow passage 62 and having an internal diameter sized to fit over the end of a tubular joint, such as tubular joint 10 in FIG. 1 and the tubular joint 20 in FIG. 2. The ring member 60 has attached, at its lower end, an upset collar member 64 having an external diameter slightly larger than the external diameter of the body 66 of the ring 60. The ring body 66 has a groove 68 which is recessed within the interior dimension of the ring body 66, which is shown in greater detail in FIG. 8. A slot 70 is milled completely through the ring body portion 66 and is aligned vertically with the internal groove 68 for reasons as set forth hereinafter.

Figure 7:
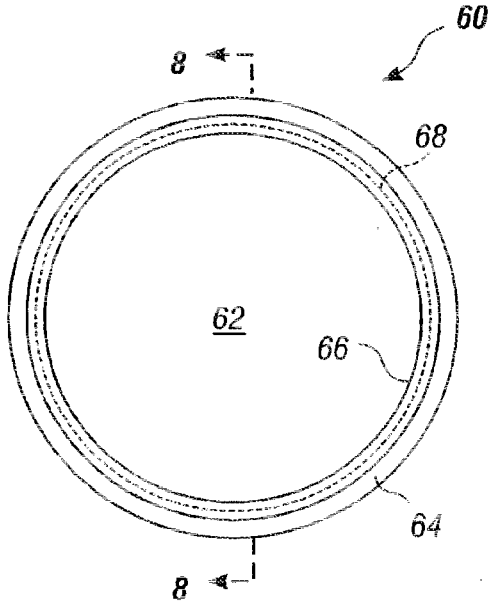
FIG. 7 illustrates the device of FIG. 6 in a top plan view.

Referring now to FIG. 7, there is a top view of the ring member 60, which illustrates the ring member 60 as having an internal passage 62 which is sized to barely slip over the exterior of an oilfield tubular, such as the casing joint 10 in FIG. 1. A groove 68 is illustrated in dotted lines, which is recessed on the internal diameter of the ring body 66.

Figure 8:
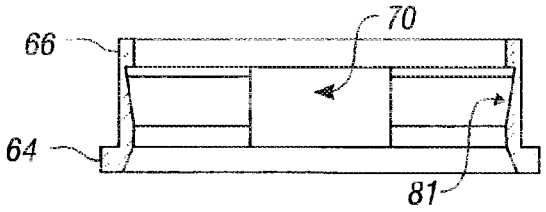
FIG. 8 is a sectional view of the device of FIG. 7, partly in cross-section, showing the sectional view of the device of FIG. 7.

Referring now to FIG. 8, there is illustrated a sectional view taken along the section line 8-8 of FIG. 7, which partly in cross section shows the ring body 66 joined at its lower end to collar member 64. The ring body 66 has the mill slot 70 vertically, aligned with the groove 68. As illustrated in FIG. 8, the groove 68 has an inclined surface 81 against which the band 80, illustrated in FIGS. 9, 10, and 11, having an inclined surface 82 is accommodated. As shown in FIG. 11, the band 80 has a gap 84 to enable the two ends of the band 80 to be connected by a latch assembly described hereinafter.

Figure 9:
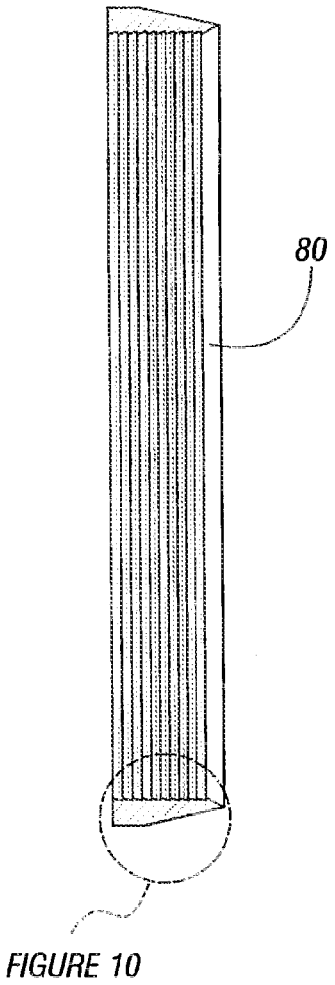
FIG. 9 is a side view of a band which is used within the interior of the device illustrated in FIG. 6.
Figure 10:
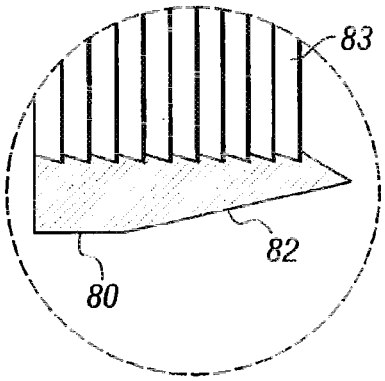
FIG. 10 is a sectional, enlarged view of a portion of the band illustrated in FIG. 9.
Figure 11:
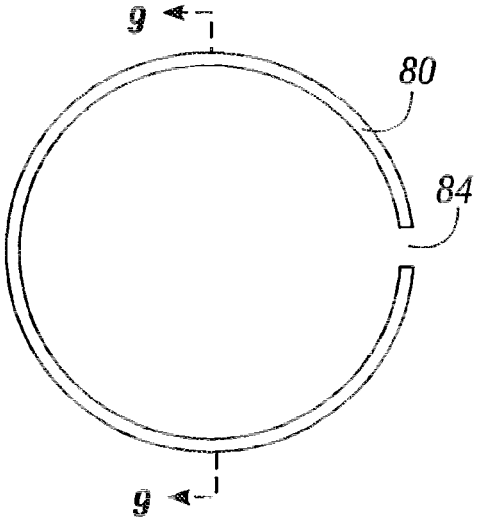
FIG. 11 is a top plan view of the band illustrated in FIG. 9 in accordance with the present invention.
Figure 27:
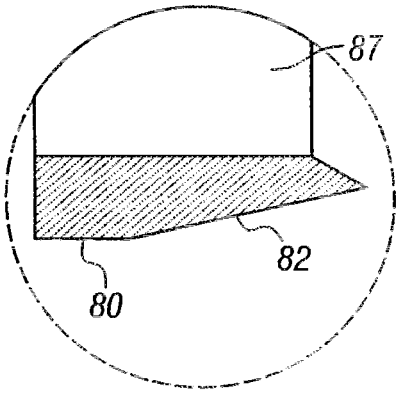
FIG. 27 is a sectional, enlarged view of a portion of the band, which is illustrated in FIG. 26.

Referring now to FIGS. 9-11, the metallic band 80 is illustrated in greater detail. As referenced above, the band 80 has a gap 84 which uses a latching assembly, described in more detail hereinafter, to draw the opposite ends of the band 80 closer together and to keep them from being spread apart when the latch assembly is latched. In FIG. 10, it is seen that the band 80 has an inclined surface 82 which will ride against the inclined surface 81 illustrated in FIG. 8. The band 80 has a saw-tooth inner diameter 83, which provides a gripping surface against which the external diameter of a tubular joint can be gripped. In an alternative embodiment, discussed in more detail below, the gripping surface can be replaced with a mechanical obstruction surface, as shown in FIGS. 27 and 28.

Figure 12:
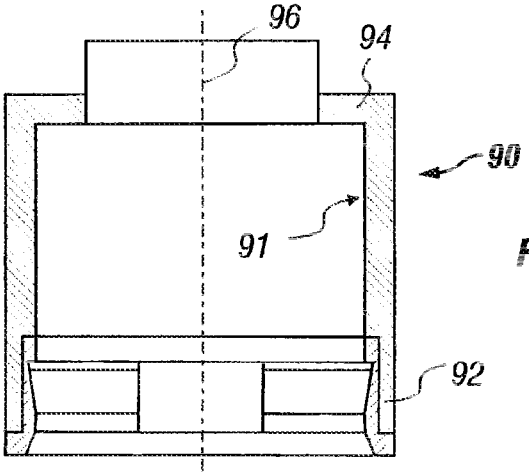
FIG. 12 is an elevated view, partly in cross-section, of a thread protector, in accordance with present invention.

Referring now to FIG. 12, the apparatus which is earlier described with respect to FIGS. 6, 7 and 8, is also illustrated in FIG. 12, but which also includes the additional thread protector body 90, which at its lower end 92, rides upon the shoulder or collar member 64 when the device is used as a thread protector for the pin end of a tubular joint, such as the pin end 14 illustrated with the tubular joint 10 in FIG. 1. With the arrangement illustrated in FIG. 12, the resulting configuration shows a flush surface between the lower end 92 and the collar member 64. The internal diameter of the thread protector body 90 is chosen to be larger than the pin end 14 of the tubular joint 10 so that the inside surface 91 of the thread protector body 90 (shown in FIG. 12) does not touch the threads of the pin end 14. The upper end 94 of the thread protector body 90 extends in towards the centerline 96 of the thread protector body 90 as an optional feature to add more protection for the threads being protected on the pin end 14 of the tubular joint 10.

The thread protector body 90, illustrated in FIG. 12, can be non-metallic, for example plastic or hard rubber, to further decrease the possibility of the thread protector body 90 damaging the threads of the pin end 14.

Figure 13A:
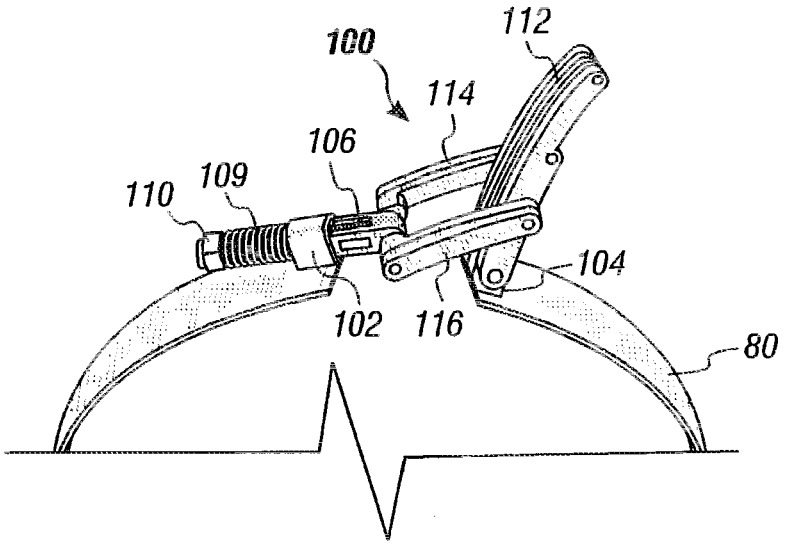
FIG. 13A is a pictorial view of the latching arrangement in the open position for use with the band illustrated in FIG. 11.
Figure 13B:
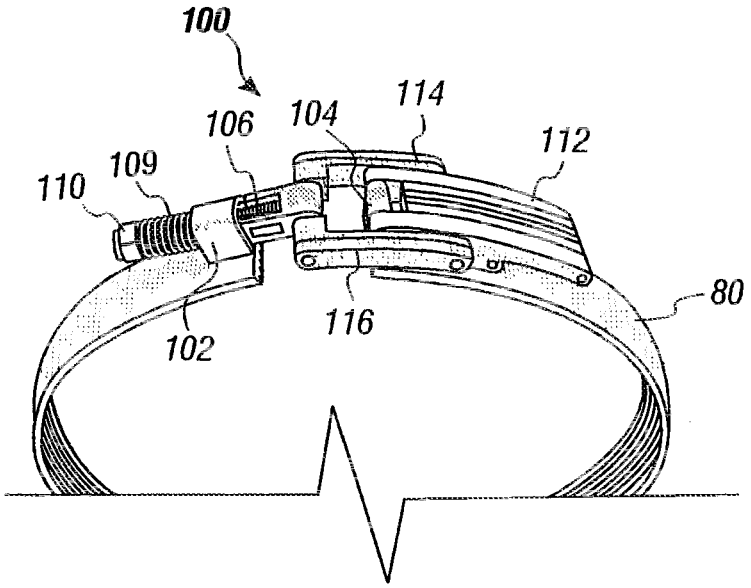
FIG. 13B is pictorial view of the band illustrated in FIG. 13A but which has been moved to the closed position of the latching apparatus.

Referring now to FIG. 13A and FIG. 13B, an isometric view of the latch assembly 100 is illustrated which shows the band 80, as illustrated in FIGS. 9, 10 and 11. The latch assembly 100 can be used to narrow the gap 84, which is illustrated in FIG. 11. A padeye 102 can be attached to the other end of the band 80. A draw bolt 106 passes through the padeye 102 and has a spring 109 which is held on to the draw bolt 106 by a nut 110, which can be adjusted, as needed, to vary the tension in the band and to control the grip action of the band 80. FIG. 13A and FIG. 13B show a handle 112 that is attached to a padeye 104. A pair of latch links 114 and 116 are shown attached to a second end of the draw bolt 106, and the pair of latch links can be attached at their second ends to the handle 112, as also shown.

Figure 14A:
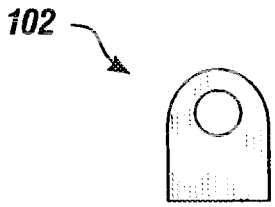
FIG. 14A is padeye which is used with the latching assembly of FIG. 13 in accordance with the invention.
Figure 14B:
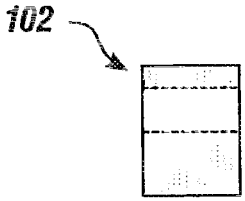
FIG. 14B is a different view of the padeye illustrated in FIG. 14.
Figure 15A:
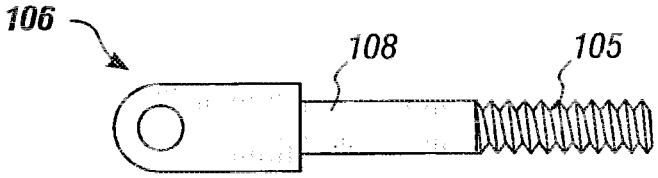
FIG. 15A is a side view of a draw bolt which is used in the latching mechanism illustrated in FIG. 13.
Figure 15B:
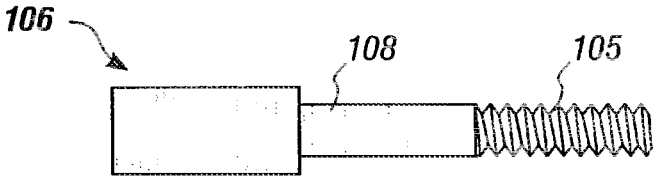
FIG. 15B is a different view of the draw bolt illustrated in FIG. 15.
Figure 16A:
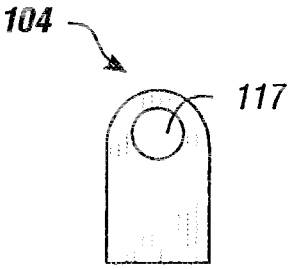
FIG. 16A is a view of the handle padeye which is used in the latching mechanism illustrated in FIG. 13.
Figure 16B:
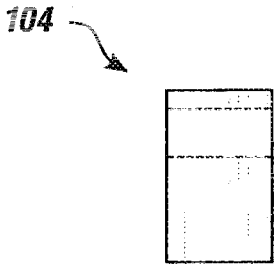
FIG. 16B is a different view of the handle padeye illustrated in FIG. 16.

Referring now to FIG. 14A and FIG. 14B, the draw bolt padeye 102 is shown in greater detail. In FIGS. 15A and 15B, the draw bolt 106 has a first threaded end (105), a smooth intermediate section 108, and a second end having a through-hole 111 through which the through-hole may receive an axis bolt, which allows the links 114 and 116 to pivot. It should be appreciated that the intermediate smooth section 108 of the draw bolt 106 passes through the center portion of the padeye 102 and that the spring 109, illustrated in FIGS. 13A and 13B, is maintained between the padeye 102 and the nut 110. It should be appreciated that the tension in spring 109 can be altered by rotation of the nut 110, by one way or the other. The handle padeye 104 is shown in great detail in FIGS. 16A and 16B.

Figure 17A:
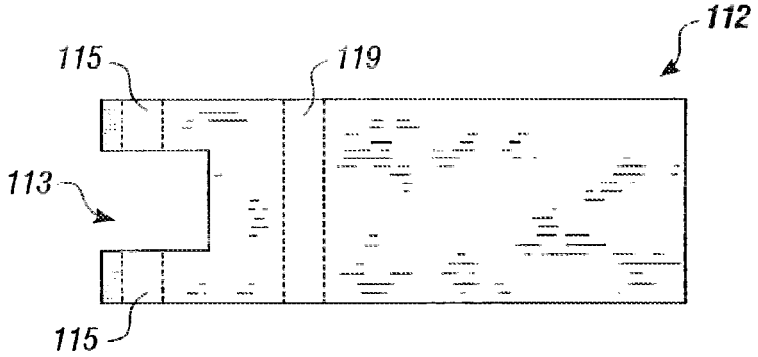
FIG. 17A is one view of the handle which is used with the latching mechanism illustrated in FIG. 13.
Figure 17B:
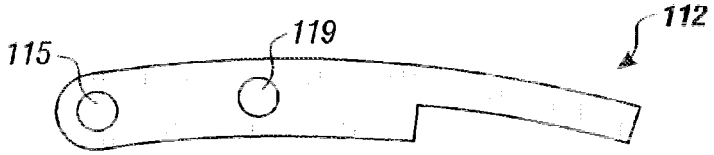
FIG. 17B is a different view of the handle shown in FIG. 17.

FIG. 17A illustrates the handle 112, and FIG. 17B illustrates a different view of the handle 112 as illustrated in FIG. 17A. The handle padeye 104, shown in greater detail in FIGS. 16A and 16B, can be arranged to be mounted within the U-shaped slot 113 of the handle 112, as shown in FIG. 17A, and the axle bolt can pass through the through-hole 115 of the handle and the hole 117 of the handle padeye 104 (shown in FIG. 16A), which allows the links 114 and 116 to pivot within the handle padeye 104 as the handle 112 is rotated.

Figure 18A:
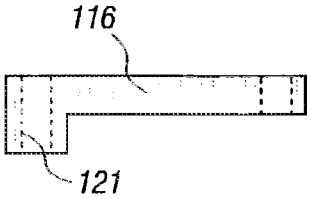
FIG. 18A is a view of a link which is used in the latching mechanism illustrated in FIG. 13.
Figure 19A:
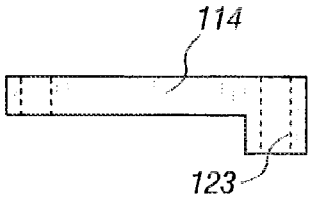
FIG. 19A is one view of a second link used in the latching mechanism illustrated in FIG. 13.
Figure 18B:
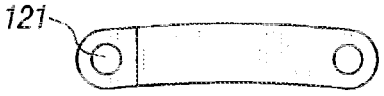
FIG. 18B is a different view of the link illustrated in FIG. 18.
Figure 19B:
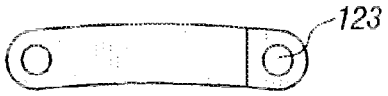
FIG. 19B is a different view of the second link illustrated in FIG. 19.

The handle 112 also has a through-hole 119, which allows an axial bolt to pass through the through-hole 119, in addition to the through-holes 121 and 123, of the link arms 116 and 114, respectively. The two latch links 116 and 114 are illustrated in FIGS. 18A and 19A, respectively. It should be appreciated that FIG. 18A is merely a difference view of the link shown in FIG. 18B, and that FIG. 19A is the same link as FIG. 19B, but shown from a different view.

Figure 21A:
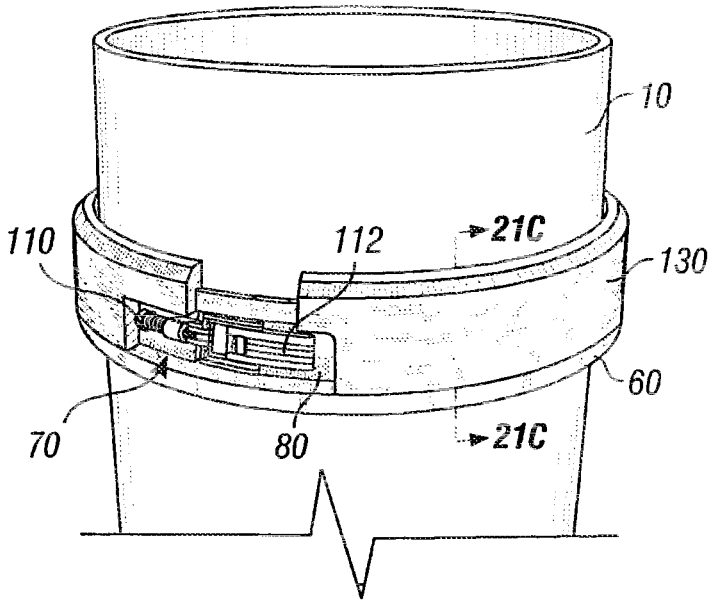
FIG. 21A is an elevated, isometric view of an alternative view of the load ring according to the present invention having a second ring made of hard plastic to protect the latch mechanism when passing through the elevator slips.

In using the band 80 having the handle 100, which is shown in its open position in FIG. 13A, the band 80 within the ring 60 is slipped over one end of the tubular joint 10, as shown in FIG. 21A. When the device is used as a thread protector, it is usually slipped over the end of the tubular joint 10 having the pin end 14. When the band configuration is used as a lift ring, to which there will be attached an elevator, the device will be slipped over the box end of the tubular joint, assuming that the casing is usually run into the well with the box end up. Encasing the band 80 over the casing joint, it is first placed within the ring 60, illustrated in FIG. 6, so that it will rest within the groove 68. The handle 100 will be exposed to the rig hand through the mill slot 70. Thus, with the ring 60 of FIG. 6 having the band 80 within the groove 68, the assembled device having the ring 60 and the band 80 is slipped over the end of the tubular joint. As illustrated in FIG. 6, the ring 60 will have its shoulder end 64 placed over the casing joint, and when properly positioned, which is usually a foot or so below the box end of the tubular joint 10, then the handle 112 for the latch mechanism 100 will be rotated away from the end having the nut 110 thereon. The latch is illustrated in the closed position in FIG. 13B. Closing the handle, in this manner, causes the two ends of the band 80 to be brought closer together, where the internal diameter of the band is resting up against the exterior of the tubular joint 10. As seen in FIGS. 8 and 9-11, as the inclined surface 82, shown in FIG. 10, tries to run down the inclined surface 81 of FIG. 8, the band 80 moves tighter and tighter against the external surface of the tubular joint 10. The additional weight of the casing joint only tends to make the connection tighter and tighter against the external surface of the tubular joint 10.

When using the ring apparatus shown in FIG. 6 with the band 80 therein, and when the device is to be used as a thread protector, it will be turned upside-down and run past the pin end 14 to a point at which the band 80 will contact the exterior surface of the tubular joint 10, but the body 90 of the thread protector, shown in FIG. 12, will not contact the threads of the pin end 14. Any movement of the casing joint 10, with respect to the thread protector, only makes the band 80 tighten against the exterior surface of the tubular joint 10, which prevents the thread protector from falling off of the tubular joint 10 and will, thus, protect the threads of the pin end 14 until such time as the handle 112 is rotated back in the other direction to allow the band 80 to fit more loosely around the tubular joint 10 and, thus, allow the thread protector to be easily removed from the tubular joint 10.

Figure 20:
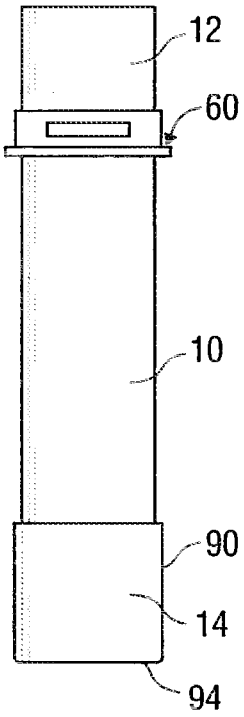
FIG. 20 is an elevated, pictorial view of a joint of oilfield tubular having a lift load ring on the box end of the tubular and a thread protector on the pin end of the tubular, in accordance with the present invention.

Referring now to FIG. 20, a prior art joint of oilfield tubular 10, such as is illustrated in greater detail in FIG. 1 and having an upper box end 12 and a lower pin end 14, is illustrated as having a load lifting ring 60, in accordance with the present invention. The load lifting ring 60, as shown, is attached near the upper box end 12, having the internal threads, and FIG. 20 also includes the thread protector body 90 shown, in accordance with the present invention, connected near the lower pin end 14 of the tubular 10 for protecting the male thread 14, such as is illustrated in FIG. 1, but could also include the lower pin end having the male threads 24, such as are illustrated in FIG. 2. The upper end 94 of the thread protector body 90 as shown in FIG. 20, can be usable for providing additional protection for the threads being protected on the lower pin end 14 of the tubular joint 10.

Thus, it should be appreciated that both the load lifting ring 60 and thread protector body 90, both in accordance with the present invention, can be used on the same joint of oilfield tubular as the tubular is being manipulated, such as moving the tubular from a horizontal to a vertical position, or vice versa. Alternatively, moving the tubular can include tripping the tubular into or out of a wellbore, such as is commonly done on an oilfield drilling rig or a completion rig, when tripping casing into or out of the wellbore.

Figure 21B:
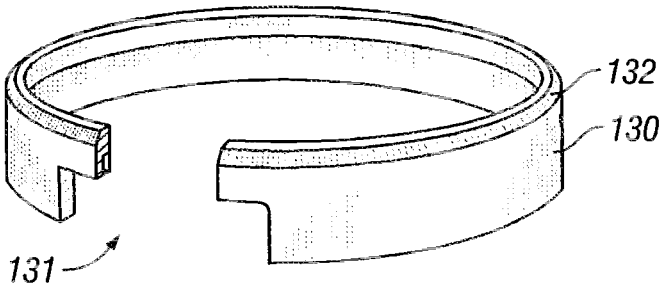
FIG. 21B is an elevated, isometric view of the hard plastic ring illustrated in FIG. 21A.
Figure 21C:
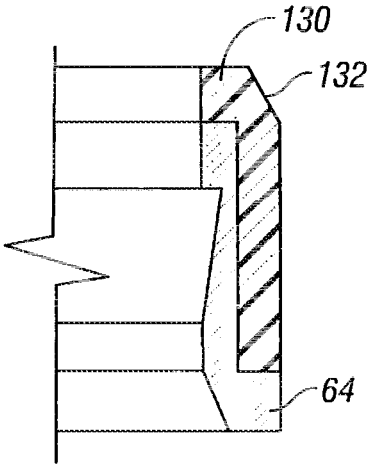
FIG. 21C is an elevated, cross-sectional view of the load ring taken along the section line 23A-23A, illustrated in FIG. 21A.

FIG. 21A is an elevated, isometric view of a box end of a partial length of an oilfield tubular 10, illustrating the ring member 60 (i.e., load lifting ring) as illustrated in FIG. 6, but having an optional or second ring member 130, also illustrated in FIGS. 21B and 21C. The ring member 130 preferably can be a split ring, manufactured, milled, formed, extruded, modeled or otherwise made from nylon, TEFLON* (* Trademark of Dupont de Nemours, E.I. & Co., trademark for tetrafluoroethylene fluorocarbon polymer), high density polypropylene or other hard plastic, or a combination of two or more hard plastics, to protect the latch mechanism 100, as illustrated in FIGS. 13A and 13B, when the combined apparatus, having the load lifting ring 60 and the optional or second ring member 130, is passing through the elevator slips (not illustrated). By having the optional or second ring member 130 be a split ring, and by the internal diameter of the ring member 130 being slightly smaller than the outside diameter of the tubular 10, the ring member 130 can form a more snug fit against the tubular 10. In addition, as shown in cross-section in FIG. 21C, the ring member 130 can be bonded to the sidewall of the ring body 66, and against the top surface (not illustrated) of the collar member 64 illustrated in FIG. 6.

The ring member 130 can have a cut-out portal 131, which can be aligned with the slot 70, illustrated in FIG. 6, to allow access to the latch mechanism 100. The top end of the ring member 130 has a beveled edge 132 to also facilitate passing the combination load ring through the elevator slips.

Figure 22A:
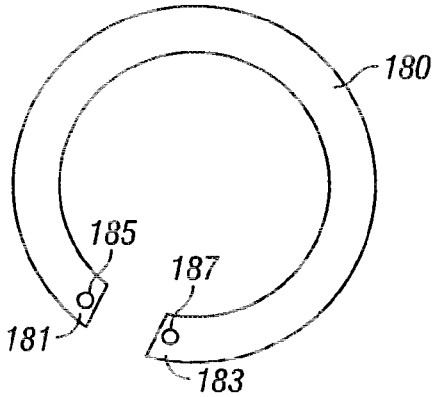
FIG. 22A is a top-plan view of the band 180 which is analogous to the band 80, both as to design and as to function, but having different means to cause its two ends to be moved closer together.

Referring now to FIG. 22A, there is illustrated a ring band 180 which is essentially identical to the band 80 illustrated in FIG. 11. The ring band 180 has first and second ends 181 and 183, respectively, having pins 185 and 187, respectively.

Figure 22B:
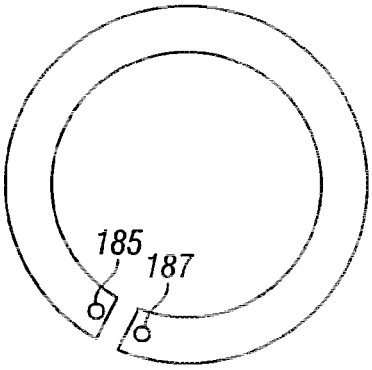
FIG. 22B is a top-plan view of the band 180, as illustrated in FIG. 22A, but having its two ends moved closer together.

As illustrated in FIG. 22B, the ends 181 and 183, along with the pins 185 and 187, are illustrated as being moved closer together.

Figure 22C:
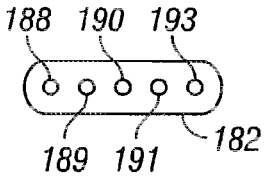
FIG. 22C is a top-plan view of a second band 182 for maintaining the two ends of the first band 180 closer together.

FIG. 22C illustrates a plate 182 having a plurality of holes therein. For example, the plate shown in FIG. 22C includes five holes numbered 188, 189, 190, 191 and 193. In use, the hole 188 slidably fits over the pin 185, shown in FIG. 22B, and one of the other holes (189, 190, 191 or 193) can be slidably fitted over the pin 187 to hold the ends 181 and 183 closer together, as illustrated in FIG. 22B. Prior to placing the plate 182 over the pins 185 and 187, the ends 181 and 183 can be pushed closer together by hand or by a tool, as appropriate.

Figure 22D:
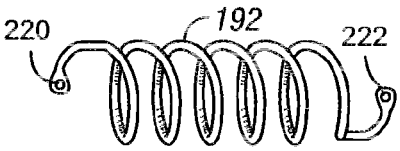
FIG. 22D is a top-plan view of a spring 192 serving as an alternative means for establishing and maintaining the two ends of the band 180 closer together.

FIG. 22D illustrates an alternative method and apparatus for pulling the two ends 181 and 183 closer together. The spring 192, having a pair of hooks 220 and 222 at the respective ends of the spring 192, are placed over the pins 185 and 187, respectively, while the spring 192 is pulled apart by hand, or by a chosen tool. By then releasing the spring 192, the ends 181 and 183 are pulled closer together and are maintained closer together by the spring 192. It should be appreciated that in the relaxed position of the spring 192, the pins 185 and 187, in the relaxed position of the band 180 as illustrated in FIG. 22A, are distanced apart by an amount greater than the distance between the hooks 220 and 222.

Figure 22E:
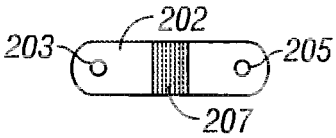
FIG. 22E is a top-plan view of yet another alternative means for establishing and maintaining the two ends of the band closer together.
Figure 22F:
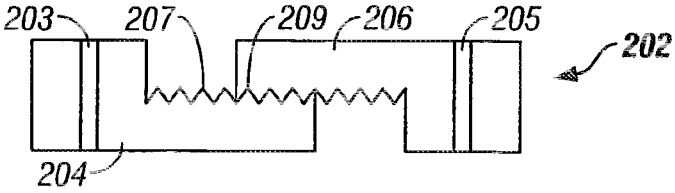
FIG. 22F is a side, elevated, schematic view of the device illustrated in FIG. 22E.

FIGS. 22E and 22F illustrate an alternative embodiment of the invention using a slidable plate 202. In operation and as shown in FIG. 22F, the holes 203 and 205 are slidably placed onto the pins 185 and 187 and, then, a first plate 204 and a second plate 206 are caused to slide towards each other by having a first ratcheting surface 207 on the first plate 204 and a second ratcheting surface 209 on the second plate 206. The ratcheting movement of the first and second plates causes the two ends 181 and 183 to be moved closer together and maintained in that position.

It should be appreciated that although the clamping mechanism 100, illustrated in FIGS. 13A and 13B, can be a preferred embodiment of the apparatus for pulling the ends 181 and 183 closer together to thereby contact the exterior of the casing, the additional means, illustrated in FIGS. 22A, 22B, 22C, 22D, 22E and 22F, also function to cause the band 80, or 180 as the case may be, to be moved closer together to reduce the internal diameter of the band 180 to thereby contact the exterior surface of the casing and, thus, enable the load lifting ring 60 and/or the thread protector body 90 to function as contemplated by this invention.

In alternative embodiments, the ring, in connection with the band as described above, can be modified to connect or lift a tubular having an upset, which can include a tubular with a tapered or swaged section or connection, or a tubular with an integral box end. For purposes of the application, an upset tubular shall include any tubular that has a change, reduction or variance in the outer diameter. Examples of upset tubulars shall include, but are not be limited to, tapered tubulars, swaged tubulars, tubulars with a box end, or any combinations thereof.

In the alternative embodiments, discussed below, an apparatus for creating a mechanical obstruction or mechanical interference can be utilized to lift the upset tubulars. As shown in FIGS. 23A, 23B, 24A, 24B and 25, the apparatus 460 for lifting upset tubulars can comprise a band 456, such as a first housing, and a ring 410, such as a second housing.

Figure 23A:
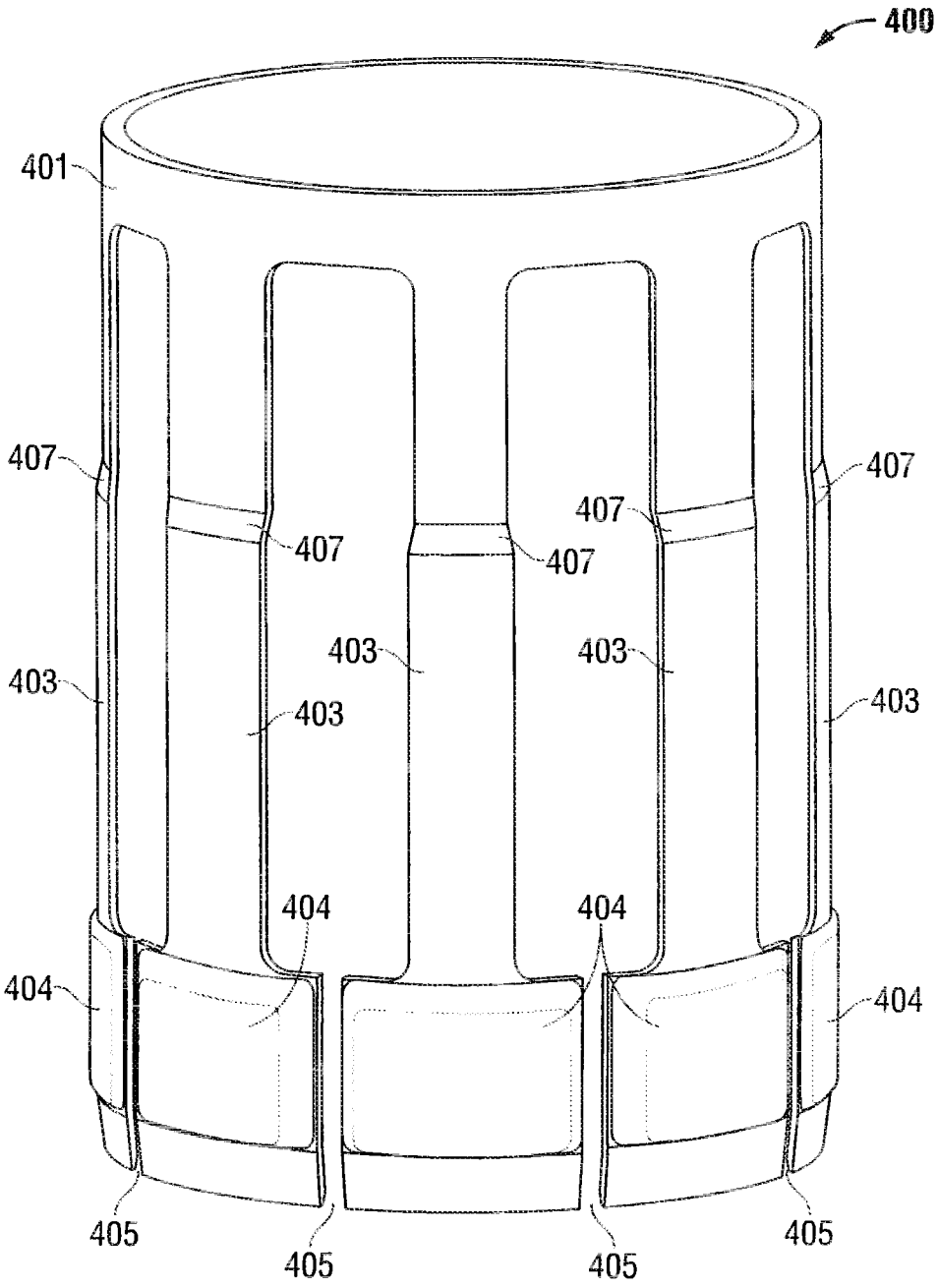
FIG. 23A is a perspective view of a ring collet.
Figure 26:
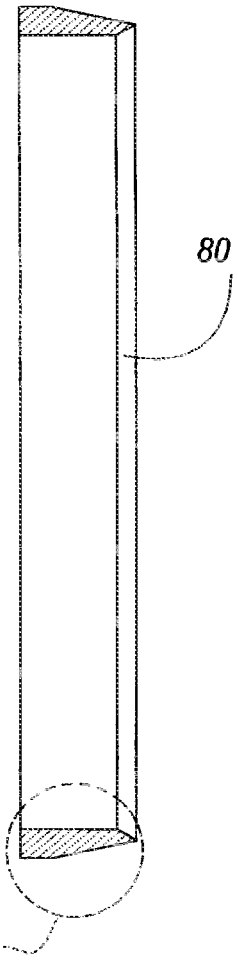
FIG. 26 is a side view of an alternative embodiment of the band that is used within the interior of the device illustrated in FIG. 6.

In an embodiment, the band 456 can comprise a substantially cylindrical ring collet 400, which can comprise a mechanical obstruction structure 404 on the unsupported end, as shown in FIG. 23A. In an embodiment, the band can comprise elongated members or blades 403, such as fingers 403, which can support the mechanical obstruction structure 404 on the unsupported end. A mechanical obstruction structure or a mechanical obstruction surface can be the area on the band, or the second housing, which contacts the external diameter of the upset tubular, wherein the mechanical obstruction structure can lift the tubular by providing structural support to the upset tubular 450 (shown in FIGS. 24A and 24B). In this alternative embodiment, the mechanical obstruction structure(s) 404, or the mechanical obstruction surface(s) 87, can replace the gripping structure(s) on any band, as described above. For example, the saw-tooth inner diameter 83 of the band 80, as shown in FIGS. 9 and 10 regarding the gripping device, can be replaced with a smooth inner diameter 87, as shown in FIGS. 26 and 27, for providing the mechanical obstruction surface(s) 87 of the mechanical obstruction structure(s) 404.

Figure 23B:
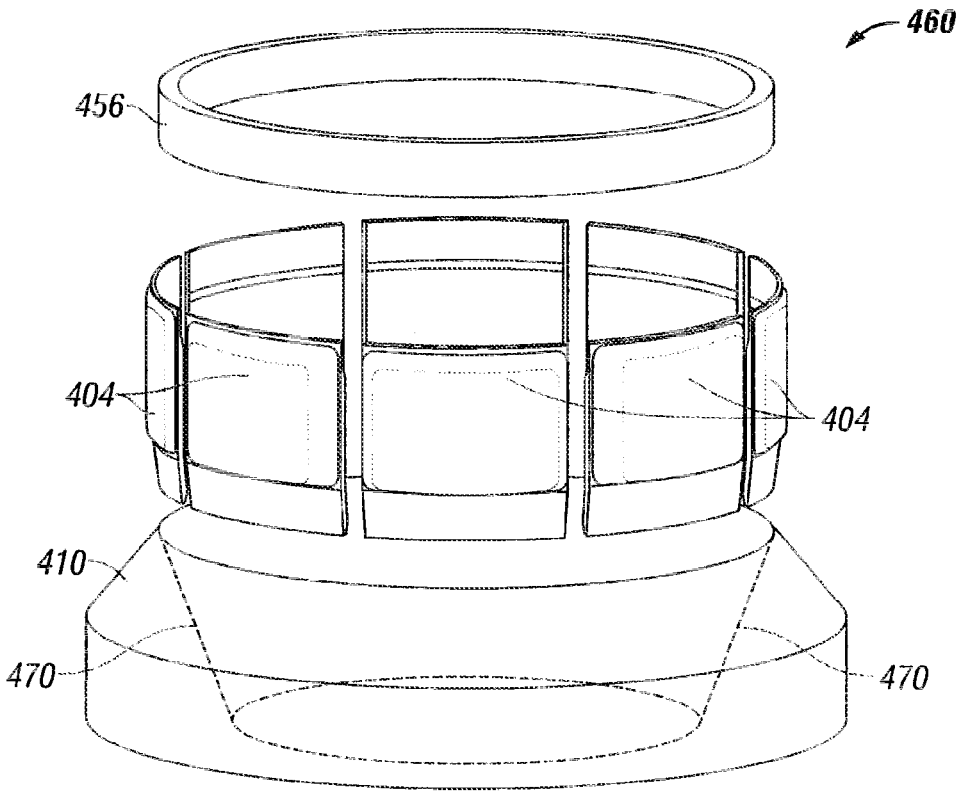
FIG. 23B is a perspective view, of an alternative embodiment, showing the mechanical obstruction structure unattached to both the first housing and the second housing when the lifting device apparatus is disengaged with an upset tubular.

FIG. 23B shows a perspective view of an alternative configuration to the embodiment shown in FIG. 23A, in which the mechanical obstruction structures 404 are not connected to the first housing or band 456. In FIG. 23B, the individual mechanical obstruction structures 404 are shown unattached to both the first housing 456 and the second housing 410, when the load lifting apparatus 460 is disengaged with an upset tubular (not shown).

When the load lifting apparatus 460 is to be brought in contact or engagement with the upset tubular, the mechanical obstruction structures 404 are brought into contact with the first housing 456 and/or the second housing 410, for connecting the two housing(s) of the load lifting apparatus 460; and then, the mechanical obstruction structures 404 can be compressed against the upset tubular 450.

FIG. 23B illustrates a sloped internal surface 470, of the second housing 410, for retaining and compressing the mechanical obstruction structure 404. In this embodiment, the internal diameter of the sloped internal surface 470 can decrease to continuously compress the mechanical obstruction structures 404, as the mechanical obstruction structures 404 are inserted deeper, or are recessed, into the second housing or ring 410. Furthermore, in another embodiment, an external pressure produced from, for example, a mechanical contact with the ring or second housing 410 or a spring or spring-loaded mechanism, can be applied to the mechanical obstruction structures 404 for compressing the mechanical obstruction structures 404 against the upset tubular 450, and for further holding or retaining the mechanical obstruction structures 404 in place.

In an alternative embodiment of the load lifting apparatus 460, one or more ball bearings (not shown) can be utilized to quickly connect the mechanical obstruction structures 404 with the first housing 456 and/or the second housing 410, or to retain mechanical obstruction structures 404 against the upset tubular. In one embodiment, at least part of the mechanical obstruction structure 404 can comprise a plurality of ball bearings. In a specific embodiment, a plurality of ball bearings can be positioned inside at least one of the housings, and with compressive force(s), one or more of the plurality of ball bearings can protrude to contact the upset tubular. Once engaged by a mechanical obstruction structure comprising the plurality of ball bearings, the upset tubular can be safely positioned or lifted.

In order to engage an upset tubular for enabling the safe lifting of the tubular, the internal diameter of the mechanical obstruction structures 404, when engaged, should be less than the largest external diameter of the upset tubular. Therefore, the load lifting apparatus 460 should be capable of sufficiently compressing the mechanical obstruction structures 404 to engage the upset tubular 450 and to form the mechanical obstruction. In forming the mechanical obstruction, the mechanical obstruction structures 404, with the use of compressive forces, can contact an upset tubular 450. This contact can change the internal diameter of the mechanical obstruction structures 404, from a diameter greater than the largest external diameter of the upset tubular to a diameter less than the largest exterior diameter of the upset tubular section, and enable the lifting of the tubular 450. This change, of internal diameter of the mechanical obstruction structures 404, allows the load lifting apparatus 460 to be placed at the upset section 458 of the upset tubular 450.

After the load lifting apparatus 460 is placed at the upset section 458 of the tubular 450, the upset tubular 450 is engaged by compressing the mechanical obstruction structures 404 against a portion of the exterior of the upset tubular 450. Upon completing the engagement, the upset tubular 450 can be lifted or hoisted, for example, by using an elevator system.

Figure 25:
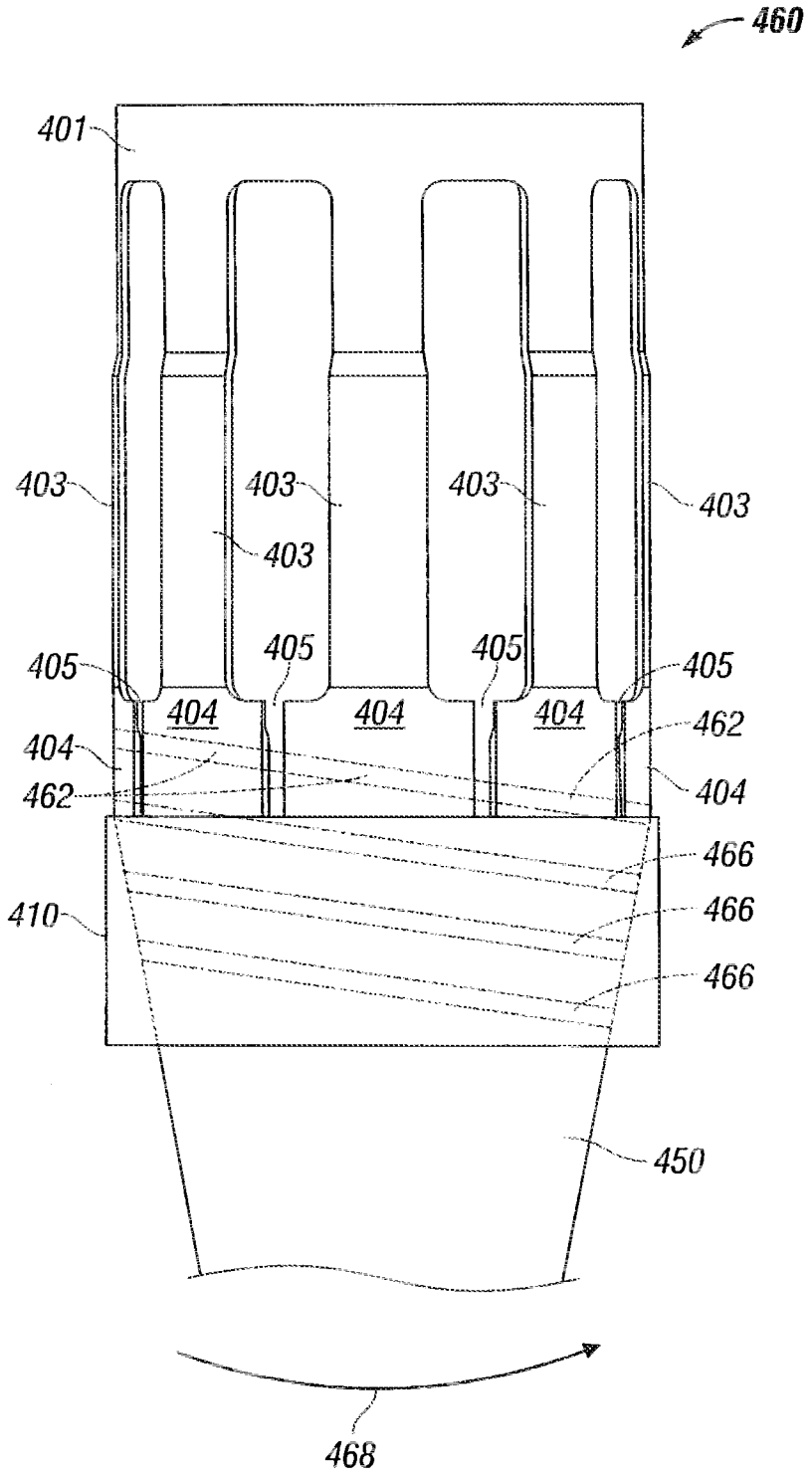
FIG. 25 is a side view of an embodiment of the mechanical obstruction structure on the collet, from FIG. 23A, being engaged by a second housing.

In the embodiment shown in FIG. 25, a mechanical device, for example, the second housing or ring 410, can be used to create the compressional force(s) that compress the mechanical obstruction structures 404 against at least part of the upset tubular 450. In an alternative embodiment, one or more spring(s) or spring-loaded mechanism(s) can be utilized for compressing the mechanical obstruction structures 404 against at least part of the upset tubular 450. In this alternative embodiment, the one or more spring(s) or spring-loaded mechanism(s) can be positioned, for example, inside the ring or second housing 410, such as within the interior surface of the ring 410.

In another embodiment, the one or more spring(s) or spring-loaded mechanism(s) can act on both the ring or second housing 410 and the band or first housing 456, as described above, to compress the mechanical obstruction structure(s) 404 against the upset tubular 450. In this embodiment, the compressional forces from the one or more spring(s) or spring-loaded mechanism(s) can maintain the position of the ring and band without the need for a mechanical connection, such as latching or screwing together the first and second housings. Persons skilled in the art, upon receiving the benefit of the disclosure herein, would recognize additional embodiments that can create the compressional force(s) and maintain the position of the ring and band, such as the use of hydraulics, pneumatics, magnetic forces or electromagnetic energy. Therefore, all possible compressional embodiments are intended to be within the scope of the claimed invention.

The use of a mechanical obstruction structure for lifting upset tubulars differs structurally and functionally from the use of a gripping device that requires a gripping surface, such as a surface having a saw-tooth edge or serrated teeth for contacting, gripping, biting and/or digging into the tubular for lifting. As set forth above, the mechanical obstruction structure(s) can be used with, or as a part of, a load lifting apparatus for safely contacting and lifting upset tubulars. As further set forth above, and in contrast to the use of gripping devices, the use of the mechanical obstruction structures 404 includes the use of compressive force(s) for changing the internal diameter of the mechanical obstruction structures 404. Accordingly, the internal diameter of the mechanical obstruction structures 404 can change, from a diameter greater than the largest external diameter of an upset tubular 450 to a diameter less than the largest exterior diameter of the upset tubular 450, for enabling the lifting of the upset tubular 450. As such, the use of mechanical obstruction structures for lifting upset tubulars does not require the use of gripping devices, gripping surfaces or frictional forces produced by the use of gripping devices having serrated teeth or saw-tooth edges, for the lifting of the upset tubulars.

In contrast, a gripping device, which is usable for lifting a tubular, functions by rigidly gripping the tubular, and in conjunction with gripping and frictional forces, structurally supports the weight of the tubular by digging or biting into the exterior surface and/or walls of the tubular. In contrast, a mechanical obstruction structure device functions by altering or varying the internal diameter of the mechanical obstruction structure of the load lifting apparatus for contacting, engaging and supporting the tubular.

Typically, gripping and frictional forces are created by serrated teeth or saw-tooth edges of a gripping surface, which are brought into contact with the exterior surface and/or walls of the tubular, by digging or biting into the exterior surface and/or walls of the tubular. Too much frictional force, caused by the contact between the teeth of the gripping surface and the surface and/or walls of the tubular, can damage the outside of the tubular and possibly the interior of the tubular, as well. Alternatively, too little frictional force between the gripping surface and the surface of the tubular can cause a loss of adequate control of the tubular, including the dropping of the tubular during lifting. Thus, too much or little friction can cause safety issues from a damaged tubular or a dropped tubular, including injuries to nearby personnel as well as damage to the tubular and the surrounding areas. Accordingly, a gripping surface must be able to grip or dig into a surface of a tubular to adequately provide sufficient gripping and frictional forces to enable the lifting of the tubular. As such, gripping devices are not suitable for use in lifting tubulars having upsets, as the varying diameters of the upset can prevent a gripping device from adequately gripping or digging into the upset tubular, which is necessary for proper lifting of the upset tubular.

In contrast, mechanical obstruction structures can support the weight of an upset tubular, directly, by using compressive forces to vary the diameter of the mechanical obstruction structures for supporting the tubular, without the need for any gripping and/or frictional forces produced from serrated or saw-tooth edges or surfaces. Therefore, a mechanical obstruction structure, or the use of a mechanical interference, can provide a safer and more sufficient apparatus, system and method for lifting upset tubulars, than systems and methods that use a gripping device. In addition, the mechanical obstruction structures, or the use of a mechanical interference, can prevent damage to the upset tubular because the mechanical obstruction structures rely directly on the structural support of the obstruction or interference, and there is no requirement for frictional forces to assist in any gripping and support of the upset tubular. For example, the mechanical obstruction surface 87 of each mechanical obstruction structure 404 can be substantially free of any serrated teeth and/or saw-tooth edges, as required by gripping devices. In an embodiment, the mechanical obstruction surface 87 can be a substantially smooth surface.

With regard to tubulars having no external upsets or changes in their external diameters, a gripping surface or device can be utilized to sufficiently grip and support the tubulars for lifting. However, with regard to tubulars having external upset sections, for example tubulars having integral box ends, tapered sections or connections and/or swaged sections and/or connections, a mechanical obstruction structure(s) is preferable to support an upset tubular for lifting. This is because the gripping devices are generally not able to grip the upset tubulars sufficiently, leading to loss of control and dropped tubulars.

Returning to FIGS. 23A, 23B, 24A, 24B and 25, in an embodiment of the mechanical obstruction structure(s) 404 usable for lifting upset tubulars 450, a mechanical obstruction surface(s) 87 (as shown in FIG. 27) replaces the gripping surface of the band 80, which was used for griping an oilfield tubular. The mechanical obstruction structure(s) 404 can be part of a load lifting apparatus 460, which can comprise a band or first housing 456 and a ring or second housing 410. The ring or second housing 410 can comprise one or more interior surfaces, and the band or first housing 456 can comprise one or more exterior surfaces and the mechanical obstruction structure(s) 404 comprising mechanical obstruction surface(s) 87. The band 456 can be disposed relative to the ring 410, such that the one or more exterior surfaces of the band 456 can contact the one or more interior surfaces of the ring 410.

At least one of the interior surfaces of the ring 410 can comprise a first portion and at least one of the exterior surfaces of the band 456 can comprise a second portion, wherein, in an embodiment, the first portion can be wider than the second portion, as shown in FIG. 12. An external force can be applied to the band 456 for moving the one or more exterior surfaces of the band 456 relative to the one or more interior surfaces of the ring 410. As a result of the external forces on the band, contact can occur between a first portion of the one or more interior surfaces of the ring 410 and a second portion of the one or more exterior surfaces of the band 456, to urge the mechanical obstruction surface 87 toward the upset oilfield tubular 450.

The band 456 can further comprise a cylindrical section, as shown in FIG. 23A. The cylindrical section can be connected to a plurality of elongated members or blades 403, in which each elongated blade 403 can comprise a mechanical obstruction structure 404, with a mechanical obstruction surface 87, on the unsupported end of the elongated blades 403. The apparatus for lifting upset tubulars 450 can comprise one mechanical obstruction structure 404 or a plurality of mechanical obstruction structures 404, for example, the mechanical obstruction structures can be joined or formed as one mechanical obstruction structure 404, or each mechanical obstruction structure can be spaced apart from the others for forming a plurality of mechanical obstruction structures 404.

Figure 24A:
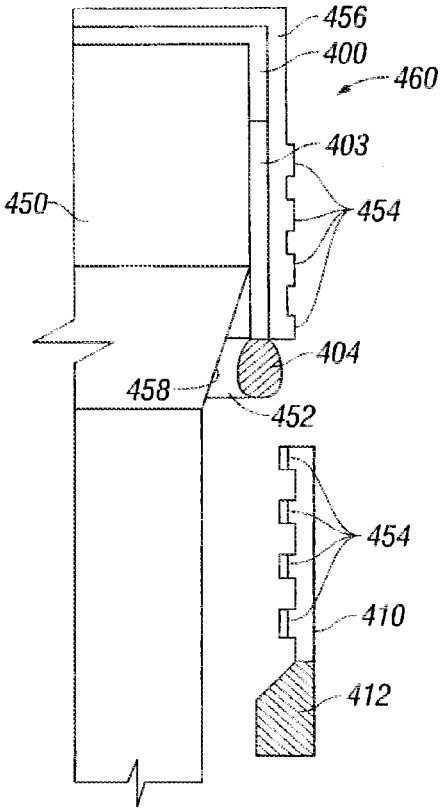
FIG. 24A is a side cross-sectional view of an embodiment of the mechanical obstruction and the load lifting device apparatus, showing the mechanical obstruction structure in the neutral or open position and disengaged with an upset tubular.
Figure 24B:
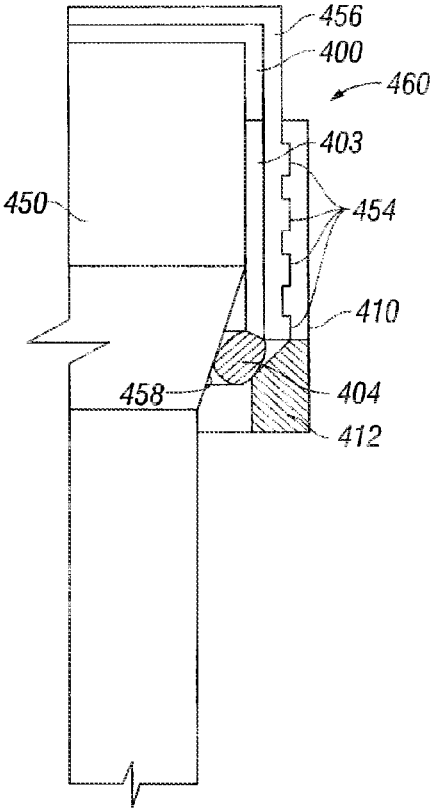
FIG. 24B is a side cross-sectional view of an embodiment of the mechanical obstruction and the load lifting device apparatus, showing the mechanical obstruction structure in the engaged or closed position.

In an embodiment, the diameter of the interior of the mechanical obstruction structure(s) 404, attached to the band 456, can be smaller than the largest exterior diameter of the upset tubular 450, after external compressive forces have been applied to the band 456 to move the exterior surface of the band 456 radially inward and relative to the interior surface of the ring 410. In addition, a latch mechanism 454, 455 as shown in FIGS. 24A and 24B, can be used with this embodiment of the mechanical obstruction structure 404.

Embodiments of the present invention can include methods for lifting a tubular, wherein a portion of the tubular comprises an upset. The steps of the method can include providing a ring, which comprises an interior surface, and providing a band, which comprises an exterior surface and a mechanical obstruction structure(s). The band can be disposed relative to the ring, such that the exterior surface of the band can contact the interior surface of the ring. In an embodiment, at least one of the interior surface and the exterior surface can comprise a first portion wider than a second portion, and an external force can be applied to the band to move the exterior surface relative to the interior surface, such that contact between the first portion and at least one of the interior surface and the exterior surface urges the mechanical obstruction structure(s) toward the upset tubular.

The steps of the method can continue by inserting the upset tubular inside the band, and engaging the upset tubular, which has been inserted inside the band, with the mechanical obstruction structure(s), by contacting the exterior surface of the band with the interior surface of the ring for enabling the engagement between the mechanical obstruction structure(s) and the upset tubular. Engagement between the mechanical obstruction structure(s) and the upset tubular includes any contact between a surface of the mechanical obstruction structure(s) and a surface of the upset tubular, which can include contact that is sufficient to enable the lifting of the tubular. The steps of the method can be completed by lifting the upset tubular, which has been engaged by the mechanical obstruction structure(s), using a lifting device, such as an elevator.

In an embodiment, the methods for lifting upset tubulars can include the upset tubular 450 being inserted inside the band or first housing 456. The upset tubular 450, while positioned inside the band or first housing 456, can be engaged by the mechanical obstruction surface(s) 87 of the mechanical obstruction structure(s) 404 by contacting the ring or second housing 410 with the mechanical obstruction structure(s) 404. Alternatively, the upset tubular 450 can be engaged by the mechanical obstruction surface(s) 87 of the mechanical obstruction structure(s) 404 by including an at least one spring or spring-loaded mechanism within the ring, for example, within the interior surface of the ring or second housing 410, and contacting or connecting the spring or spring-loaded mechanism with the mechanical obstruction structure(s) 404. The upset tubular 450, now engaged by the mechanical obstruction surface(s) 87 of the mechanical obstruction structure(s) 404 and the ring or second housing 410, can be lifted, for example, by using an elevator or other lifting device.

In another embodiment, the load lifting apparatus 460 can comprise a ring collet 400, as shown in FIG. 23A which illustrates a side view of the ring collet 400. The ring collet 400 can be a metal cage device that can be adapted, as described below, for engaging and lifting the upset tubulars 450. In this embodiment, the load lifting apparatus 460 can comprise at least two housings, with the first housing or band 456 comprising the ring collet 400, as shown in FIGS. 24A and 24B.

Referring again to FIG. 23A, the ring collet 400 can comprise a ring or a substantially cylindrical first or upper portion 401 and a second or bottom portion 402. The second or bottom portion 402 can be divided into a plurality of elongated blades or members 403, as shown in the Figure. Each elongated blade 403 can have a mechanical obstruction structure 404, which can include a mechanical obstruction surface 87, for example, a protruding surface at the unsupported end thereof. The mechanical obstruction structure(s) 404 can be continuous, or alternatively, can include small gaps or spacing 405 between the adjacent mechanical obstruction structure(s) 404.

The elongated blades 403, with the mechanical obstruction structure(s) 404, can enable the operator to easily determine or calculate measurements regarding the amount of compressive force and/or reduction in the internal diameter of the mechanical obstruction structure(s) 404, which is beneficial for safely engaging and lifting the upset tubular. In this embodiment, the lengths of the elongated members or blades 403, and the spacing 405 between the mechanical obstruction structure(s) 404, are specifically designed to provide a favorable or the desired amount of compressive force or reduction in the internal diameter of the mechanical obstruction structure(s) 404. This embodiment is beneficial for creating the required mechanical obstruction to safely lift the upset tubulars.

In an embodiment, the mechanical obstruction structure(s) 404 can be tapered outwardly or straight, when in the neutral position and not engaged with the ring or second housing 410. However, with pressure or resistance, the mechanical obstruction structure(s) 404 can be moved and can taper inwardly, such as when engaged by the ring or second housing 410.

In another embodiment, the mechanical obstruction structure(s) 404 can have a larger cross-section than the elongated blades 403. In this embodiment, the larger cross-section of each mechanical obstruction structure 404 can provide a larger surface area for contacting the exterior of the upset tubular 450 and can provide the ability to more favorably control the interior diameter of the mechanical obstruction structure 404. The larger cross-section further allows increased load bearing or structural weight carrying capabilities of the mechanical obstruction structure 404.

In one embodiment, as shown in FIG. 23A, a flange 407 is formed on the outside of the ring collet 400. Alternatively, a flange can be located on the outside of the first housing 456 or the second housing 410. The flange 407 can be used to lift the upset tubular 450 by contacting and engaging a lifting device, such as an elevator. For example, the elevator can lift the upset tubular and load lifting apparatus 460 by contacting the flange 407, located on the exterior of the ring collet 400 or the first housing 456, wherein the first housing 456 is connected to the ring or second housing 410. In this embodiment, the flange would need to be of a sufficient strength to support the weight of the load lifting apparatus 460 and the upset tubular 450.

FIGS. 24A, 24B, and 25 illustrate the first housing or band 456 being the upper housing or unit, and a second housing or ring 410 being the lower housing or unit. However, the first and second housings can be reversed; and therefore, the load lifting apparatus is not necessarily restricted to a first or upper housing and a second or lower housing, as shown in FIGS. 24A, 24B, and 25.

As can be observed in FIG. 24A, at least a portion of each elongated blade 403, including the mechanical obstruction structure 404, is substantially straight or tapered outwardly when not engaged by a second housing or ring 410. In an embodiment, the round or curved outer surface of the mechanical obstruction structure(s) 404 can be designed to be engaged by a second housing or ring 410. When the second housing or ring 410 engages the ring collet 400, the mechanical obstruction structure(s) 404 of the elongated blade(s) 403 can move inwardly and can engage an upset tubular 450 by closing radially inward, as shown in FIG. 24B. When engaged with the upset tubular 450, the mechanical obstruction structures 404 can be continuous, except for small gaps or spacing 405 between the adjacent mechanical obstruction structures 404, as shown in FIG. 23A. A ring or second housing body 410, comprising a structural band 412, can be inserted outside the mechanical obstruction structure(s) 404 and can be used to engage the mechanical obstruction structures 404 of the ring collet 403 or the first housing or band 456.

In one embodiment, at least a three-piece load lifting apparatus 460 is utilized, as shown in FIGS. 24A and 24B. In this embodiment, the ring, for example, ring collet 400 is separated from the first housing 456 and second housing 410. The ring collet 400 is sized to fit inside and be connected to the first housing 456. In this embodiment, the ring collet 400 is interchangeable and can be replaced when worn, without having to replace the entire first housing. In addition, the ring collet 400 can be interchangeable to enable an operator to select and provide the ring collet 400 with elongated members or blades 403, of a desired length, spacing and flexibility, and mechanical obstruction structure(s), with properties that provide the required amount of compression or reduction in the internal diameter of the mechanical obstruction structure(s) 404 and provide the structural load bearing support, to safely lift the upset tubular 450. The ring collet 400 can be secured to the first housing 456 by various means, including, but not limited to, threads, screws, mechanical connectors, bolts, adhesives, fasteners, pins or safety pins, compressional force devices, such as, sliding spring mechanisms, or any combinations thereof. In the embodiment of the three-piece load lifting apparatus 460, the second housing or ring 410 can engage the ring collet 410, when the ring collet 400 is positioned inside the first housing or band 456, as described above, for forming the three-piece load lifting apparatus 460.

The mechanical obstruction structure(s) 404, either alone or in combination with the second housing or ring 410, can provide sufficient structural support to lift the upset tubular 450. The mechanical obstruction structure(s) 404, either alone or in combination with the second housing 410, must be made of a material that is of sufficient strength to support the weight of the upset tubular 450. Suitable materials for the mechanical obstruction structure(s) 404 can include, but are not limited to, metals, alloys, high strength composite materials, and any combinations thereof.

The second housing or ring 410 can be made of materials, such as metals, alloys, composite materials or combinations thereof; however, the lower end of the second housing or ring, such as the structural band 412, can be made of a metal, a high strength alloy, a high strength metal composite, or combinations thereof.

The first housing or band 456 can be made of a lighter weight material to reduce the load or weight of the load lifting apparatus 460. Suitable materials for the first housing 456 can include, but are not limited to, light metals, such as aluminum, plastics, lighter composite materials, or any combinations thereof.

The ring collet 400 can be made of materials that are flexible enough to be sufficiently compressed for reducing the interior diameter of the mechanical obstruction structure(s) 404, located at the end of the elongated blades 403, wherein the interior diameter of the mechanical obstruction structure(s) 404 is compressed to an amount or a diameter that is less than the maximum diameter of the upset tubular, while engaged. However, the interior diameter of the mechanical obstruction structure(s) 404 must be greater than the maximum diameter of the upset tubular, when the ring collet 400 is in the neutral or disengaged position. In one embodiment, the ring collet 400 comprises the elongated blades 403, which can be flexible enough to compress the internal diameter of the mechanical obstruction structure(s) 404. This compression engages the upset tubular by eliminating the gap 452 between the mechanical obstruction structure 404 and the tapered section 458 of the upset tubular 450. For example, the compression of the internal diameter of the mechanical obstruction structure(s) 404 can be related to the outer diameter of the initial tubular and the amount of change in the outer diameter of the tubular caused by the upset. Typically, the upset differential can be one-half inch, regardless of the outer diameter of the tubular. Therefore, a one-half inch upset on a twelve (12) inch diameter tubular would require more compression of the internal diameter of the mechanical obstruction structure(s) 404, for safely lifting the tubular, than a one-half inch upset on a five (5) inch diameter tubular. Suitable materials for the elongated members or blades 403 can include, but are not limited to, flexible metals, including aluminum, plastics, composites, or any combinations thereof.

The preferred properties of the materials for the make-up of the load lifting apparatus, including the mechanical obstruction structures 404, can depend, directly, on the upset tubular. For example, a larger tubular, with a one-half inch offset, would require more compression of the mechanical obstruction structures 404 and, thus, more flexible material(s) for the make-up of the load lifting apparatus, including particularly the mechanical obstruction structures 404, than a smaller tubular with a one-half inch upset. In addition, a larger upset tubular is typically heavier and, thus, may require stronger materials for the make-up of the load lifting apparatus, including the make-up of the mechanical obstruction structures 404, for providing the structural strength necessary to lift the tubular. Persons skilled in the art, with the benefit of the disclosure herein, could design and engineer the load lifting apparatus, using materials to provide favorable properties, based upon the upset tubular that is being engaged.

The exterior sidewalls or outer walls of the mechanical obstruction structure(s) 404 can have circumferential threads or grooves 462, which can be complementary to the threads or grooves 466 on the interior surface of the second housing or ring 410, as shown in FIG. 25. In one embodiment, the circumferential threads 462 can mate with corresponding threads 466 on the interior of the second housing 410, wherein the second housing 410 can be a bodynut. The interior of the bodynut can have a complementary taper to the taper of the engaged mechanical obstruction structure(s) 404 that are in contact with the upset tubular 450.

In FIG. 25, the circumferential threads 462 and complementary threads 466, described above, are shown as dashed lines. To engage or "make-up" a connection between the load lifting apparatus 460 and the upset tubular 450, the upset tubular 450 can be inserted into the bottom of the mechanical obstruction structure(s) 404 of the ring collet 400. During tubular insertion, the second housing or ring 410 can be either completely removed from the ring collet 400 or only slightly engaged with the mechanical obstruction structure(s) 404. Such an "open" or "disengaged" position of the load lifting apparatus 460 is shown in the cross-sectional view of FIG. 24A. In the open or disengaged position, as shown in FIG. 24A, there is a gap 452 between the mechanical obstruction structure(s) 404 and the taper 458 of the upset tubular 450. From FIG. 24A, it can be seen that the inner surface of the mechanical obstruction structure(s) 404, or the mechanical obstruction structure(s), can be of any shape (e.g., flat, curved, circular, square), size and/or structural configuration that provides the necessary and/or desired flexibility, surface area and structural properties needed for contacting and/or lifting a tubular.

In an embodiment, the second housing 410 or bodynut can be rotated in the direction of arrow 468, for forming a "made-up" position of the load lifting apparatus 460, as shown in FIG. 24B. Comparing FIGS. 24A and 24B, it can be observed that as the second housing or ring 410 is inserted into the made-up position, its inner surface, (including threads 466 in an embodiment), can compress against the mechanical obstruction structure(s) 404. This compression can move or flex the elongated members or blades 403 inwardly until the mechanical obstruction structure(s) 404 at least partially contact or engage a sidewall of the upset tubular 450. The specific orientation of the elongated members or blades 403 and the mechanical obstruction structure(s) 404 can allow the mechanical obstruction structure(s) 404 to engage at least part of the upset section 458 of the upset tubular 450. This embodiment can engage and lift an upset tubular 450, including but not limited to, a tapered tubular, a swaged tubular, and/or a tubular comprising a box end, by partially contacting the upset section 458 of the tubular 450.

The first housing or band 456 and the second housing or ring 410 can be secured with a connection, such as a latching mechanism, to assure that the load lifting apparatus 460 cannot be rotated or disengaged, and to prevent an undesired release of the upset tubular or casing 450. As such, one purpose of this connection is to prevent any undesired movement of the first and/or second housing(s), or the entire load lifting apparatus 460. Suitable connectors can include, but are not limited to, fasteners, latches or latching mechanisms, nuts, bolts, screws, pins, adhesives, and combinations thereof. For example, the connector can be a sliding safety latch, such as a latch and pin mechanism, for securing the first housing or band 456 with the second housing or ring 410. The sliding safety latch can be any safety latch, or the sliding safety latch can utilize the inventive ring and band embodiment disclosed herein. In one embodiment, duck-tail notches 454 on the upper perimeter of the band or first housing 456 are designed to be complementary and to latch onto the notches 455 on the interior of the ring or the second housing 410. Therefore, the connected first and second housings cannot be disconnected or unscrewed until the latch is removed. This latching system can ensure that the first and second housings are latched and locked together until the operator disengages the housings.

In alternative embodiments, combinations of mechanical obstruction structures and gripping structures can be used to lift tubulars, including a tubular having an upset. While various embodiments of the present invention have been described with emphasis, it should be understood that within the scope of the appended claims, the present invention might be practiced other than as specifically described herein.

The invention claimed is:

1. An apparatus usable for lifting an upset tubular, the apparatus comprising:

a ring comprising an interior surface, the interior surface comprising a groove;

a band comprising an exterior surface, wherein the band is disposed relative to the ring such that the exterior surface of the band contacts the interior surface of the ring within the groove; and at least one mechanical obstruction structure connected to the band, wherein at least one of the interior surface and the exterior surface comprises a first portion wider than a second portion, and wherein an external force applied to the band moves the exterior surface relative to the interior surface such that contact between the first portion and at least one of the interior surface and the exterior surface compressively urges the at least one mechanical obstruction structure toward the upset tubular.

2. The apparatus of claim 1, wherein the band further comprises a substantially cylindrical section, wherein the substantially cylindrical section is connected to a plurality of elongated blades, wherein each elongated blade comprises the at least one mechanical obstruction structure on an unsupported end of the plurality of elongated blades.

3. The apparatus of claim 2, wherein the at least one mechanical obstruction structure has a larger cross-section than at least a portion of the plurality of elongated blades.

4. The apparatus of claim 1, wherein the at least one mechanical obstruction structure has an interior diameter that is smaller than a largest exterior diameter of the upset tubular after an external force is applied to the band for moving the exterior surface relative to the interior surface.

5. The apparatus of claim 1, further comprising a latch mechanism to secure the ring to the band.

6. The apparatus of claim 5, wherein the latch mechanism comprises a plurality of notches on an outer perimeter of the band, wherein the plurality of notches on the outer perimeter of the band are designed to be complimentary and to latch onto a plurality of notches on the interior of the ring.

7. The apparatus of claim 1, wherein the ring further comprises an orifice formed therein, and wherein the orifice is aligned with the groove.

8. The apparatus of claim 1, further comprising a thread protector body engaged to an exterior of the ring.

9. The apparatus of claim 8, wherein the ring further comprises an external shoulder, and wherein an end of the thread protector body contacts the external shoulder.

10. The apparatus of claim 1, wherein the at least one mechanical obstruction structure and at least a portion of the ring comprise a material made of a metal, an alloy, a high strength composite material, or combinations thereof, and wherein the material provides sufficient strength to support the weight of the upset tubular.

11. A method for lifting an upset tubular, wherein the method comprises the steps of:

providing a ring comprising an interior surface, the interior surface comprising a first groove;

providing a band comprising an exterior surface, a second groove, and at least one mechanical obstruction structure;

disposing the band relative to the ring such that the exterior surface of the band contacts the interior surface of the ring, wherein at least one of the interior surface and the exterior surface comprises a first portion wider than a second portion;

inserting the upset tubular inside the band;

applying an external rotational force to the band for moving the exterior surface relative to the interior surface such that the first and second grooves are aligned, and contact between the first portion and at least one of the interior surface and the exterior surface compressively urges the at least one mechanical obstruction structure toward the upset tubular;

engaging the upset tubular, inserted inside the band, with the at least one mechanical obstruction structure by contacting the exterior surface of the band with the interior surface of the ring for enabling the engagement between the at least one mechanical obstruction structure and the upset tubular; and lifting the upset tubular engaged by the at least one mechanical obstruction structure.

12. The method of claim 11, further comprising the steps of providing a latch mechanism, and using the latch mechanism to latch the ring to the band.

13. The method of claim 11, further comprising the step of releasing the upset tubular by disengaging the at least one mechanical obstruction structure from the upset tubular by removing the contact between the exterior surface of the band and the interior surface of the ring.

14. An apparatus for lifting a tubular, wherein at least a portion of the tubular comprises an upset, the apparatus comprising:

a ring collet connectable to and fitting inside a housing band, wherein the ring collet comprises a substantially cylindrical section;

a ring comprising an interior surface and a structural band located at a lower end; and at least one mechanical obstruction structure, wherein the structural band comprises an interior surface and engages the at least one mechanical obstruction structure, wherein the at least one mechanical obstruction structure compresses radially inward, wherein at least a portion of a mechanical obstruction surface on the at least one mechanical obstruction structure contacts the at least a portion of the tubular comprising the upset, and wherein the housing band and the at least one mechanical obstruction structure provide structural support for lifting the tubular.

15. The apparatus of claim 14, wherein the at least one mechanical obstruction structure has an interior diameter that is smaller than an exterior diameter of the upset tubular after an external force is applied to the at least one mechanical obstruction structure by the lower end of the ring for moving the at least one mechanical obstruction structure radially inward.

16. The apparatus of claim 15, further comprising a latch mechanism, wherein the latch mechanism comprises a plurality of notches on an outer perimeter of the band, wherein the plurality of notches on the outer perimeter of the band are designed to be complimentary and to latch onto a plurality of notches on the interior surface of the ring.

17. The apparatus of claim 14, wherein the substantially cylindrical section of the ring collet comprises a plurality of elongated blades, and wherein each elongated blade comprises the at least one mechanical obstruction structure on at least one unsupported end of the plurality of elongated blades.

18. The apparatus of claim 17, wherein the at least one mechanical obstruction structure comprises a larger cross-section than a portion of the elongated blade.

19. The apparatus of claim 14, wherein the mechanical obstruction surface is substantially free of serrated teeth, saw-tooth edges, or combinations thereof.

20. The apparatus of claim 14, wherein at least part of the mechanical obstruction structure comprises a plurality of ball bearings, and with compressive force, one or more of the plurality of ball bearings protrudes to contact the upset tubular.

* * * * *